US007467451B2

(12) United States Patent
Cobzaru et al.

(10) Patent No.: US 7,467,451 B2
(45) Date of Patent: Dec. 23, 2008

(54) OFFSET PULLING HEAD

(75) Inventors: Cristinel Ovidiu Cobzaru, Murrieta, CA (US); John Wilker, Huntington Beach, CA (US)

(73) Assignee: SPS Technologies, LLC, Jenkintown, PA (US)

( * ) Notice: Subject to any disclaimer, the term of this patent is extended or adjusted under 35 U.S.C. 154(b) by 0 days.

(21) Appl. No.: 11/558,509

(22) Filed: Nov. 10, 2006

(65) Prior Publication Data

US 2007/0169327 A1 Jul. 26, 2007

Related U.S. Application Data

(60) Provisional application No. 60/762,042, filed on Jan. 25, 2006.

(51) Int. Cl.
*B21J 15/04* (2006.01)
*B21J 15/24* (2006.01)

(52) U.S. Cl. ..... 29/243.521; 72/391.2; 72/391.8

(58) Field of Classification Search ..... 72/391.2–391.8; 29/243.419–243.529
See application file for complete search history.

(56) References Cited

U.S. PATENT DOCUMENTS 3,144,158 A * 8/1964 Nouvelet ..... 29/243.521
3,254,522 A * 6/1966 Elliott et al. ..... 29/243.525
3,363,445 A * 1/1968 Sanders et al. ..... 29/243.521
3,451,248 A * 6/1969 Bell ..... 29/243.523
3,491,578 A * 1/1970 Biermann ..... 29/243.521
4,005,598 A * 2/1977 Ehmann et al. ..... 29/243.523
4,117,710 A * 10/1978 Fluester ..... 29/243.521
4,347,728 A 9/1982 Smith
4,615,206 A 10/1986 Rosier
4,796,455 A 1/1989 Rosier
4,815,310 A * 3/1989 Summerlin et al. .... 29/243.523
4,910,992 A * 3/1990 Stenberg et al. ..... 29/798
4,936,134 A * 6/1990 Donnelly ..... 29/243.527
4,989,442 A 2/1991 Rosier
5,136,873 A * 8/1992 Hopkins et al. ..... 72/391.6
5,208,959 A 5/1993 Rosier et al.
5,490,311 A * 2/1996 Rosier ..... 29/243.523
5,551,301 A * 9/1996 Cowan ..... 73/708
5,575,051 A * 11/1996 Moore ..... 29/243.253
6,449,822 B1 * 9/2002 Gilbert et al. ..... 29/243.521
6,704,986 B1 * 3/2004 Liu ..... 29/243.525
6,739,170 B1 5/2004 Rosier
6,817,074 B2 * 11/2004 Lalonde et al. ..... 29/243.521

* cited by examiner

*Primary Examiner*—David B Jones
(74) *Attorney, Agent, or Firm*—Trexler, Bushnell, Giangiorgi, Blackstone & Marr, Ltd.

(57) ABSTRACT

A pulling head that can be used with a wide range of fasteners and power tools having different stroke lengths and/or power ratings. The pulling head has a set of internal jaws which has serrations that are configured to grip a wide range of fastener types and sizes. The effective stroke of the pulling head is determined by the power tool to which it is engaged, rather than by the structure and design of the pulling head. The pulling head preferably has two jaws and a jaw follower with a leading surface which provides two beveled surfaces. As a result, the trailing surface of the jaws need not be conical, thereby providing that the jaws need not be machined after they are cast, thereby providing a very low cost manufacturing solution.

17 Claims, 15 Drawing Sheets

PRIOR ART

PRIOR ART

OFFSET PULLING HEAD

BACKGROUND

The present application generally relates to an apparatus for setting a fastener by pulling on a stem of the fastener, and more specifically relates to a pulling head system for use with power tools for setting a wide range of fasteners.

Pulling heads are presently commercially available for setting fasteners. These pulling heads are configured for engagement with a power tool, such as a pneumatic or hydraulic power tool (these power tools are well known in the art; for example, the assignee of the present invention, Textron Inc., currently sells power tool model numbers G902, G746, G704 and G747 which can be used for such an application). Specifically, the pulling head is threadably engaged with the power tool, and jaws of the pulling head are engaged with the stein of a fastener when the fastener is positioned in an aperture in one or more workpieces. Then, the power tool is actuated, causing the pulling head to pull on the stem of the fastener, thereafter causing the fastener to set and the stem to break away.

Some pulling heads, such as that which is shown in FIG. 1, are regarded as being "straight" pulling heads, while others, such as that which is shown in FIG. 2 or 5, are regarded as being "offset". As shown in FIG. 1, while straight pulling heads have one or more jaws 10 which are generally aligned with the pulling force (indicated with arrow 12) which is generated by the power tool (not specifically shown), offset pulling heads, such as that which is shown in FIG. 2 or 5, generally have one or more jaws 14 which are offset from the pulling force (indicated with arrow 16 in FIG. 2) which is generated by the power tool (not specifically shown). Offset pulling heads are typically used to set blind fasteners such as blind bolts, rivets, etc., which are located in hard to reach places. For example, with regard to airplanes, as aircraft structures get smaller and more complex, a large percentage of the fasteners are installed in hard to reach places, such as very close to other structures (i.e., small edge distance), in areas obstructed by other fasteners or aircraft structure, in blind areas (for example, inside of a C channel), or in tight areas obstructed on two, or even three sides. In all of these cases, a standard straight pulling head cannot be used, because it is too large to access such areas. For comparison purposes, FIG. 4 illustrates an offset pulling head 20 being used in an obstructed area 22, and a straight pulling head 24 being used in an open access area 26.

As mentioned above, FIG. 1 illustrates a straight pulling head. The pulling head 30 includes a sleeve 32 in which is disposed a collet 34. A nosepiece 36 threads into a threaded bore 38 which is provided at the end 40 of the sleeve 32. This is beneficial as the nosepiece 36 is therefore removable, and if it becomes worn it can be easily replaced. An opposite end 42 of the sleeve 32 is provided with two lugs for engagement into the head of a power tool (not shown), and a rear end 44 of the collet 34 is internally threaded for threading onto a piston of the power tool. Inside the collet 34 are disposed a set of three jaws 10 which are kept generally together by an o-ring 46. Rearward of the jaws 10 is a jaw follower 48, which consists of a sleeve 50 and a cap 52. A compression spring 54 is also provided, and the spring 54 works to spring bias the cap 52 away from the sleeve 50. As shown in FIG. 1, an angled, rear surface 56 of the nosepiece 36 engages an angled, leading edge surface 58 of each of the three jaws 10, thereby tending to spread the jaws 10 open. As shown, the collet 34 includes an undercut 60 on its interior surface 62 for accommodating expansion of the jaws 10. Furthermore, each of the jaws 10 includes a back, angled surface 64 which engages a corresponding conical surface 66 on the cap 52 of the jaw follower 48, also tending to spread the jaws 10 open. As such, the jaws 10 are normally open when no fastener stem is inserted into the nosepiece 36. This helps to limit wear on serrations 70 of the jaws 10 because the stem need not be slid through a set of closed jaws when the stem is initially inserted into the nosepiece 36.

Although the pulling head design shown in FIG. 1 has several beneficial features, such as the removable nosepiece 36, some disadvantages include the fact that the pulling head 30 can only be used to install a single type (i.e., size) fastener. Specifically, serrations 70 of the jaws 10 are designed such that the jaws 10 can only grip one size fastener, and the opening 72 in the nosepiece 36 is sized such that the pulling head 30 is limited with regard to how big of a stem can be inserted into the pulling head 30. Furthermore, the fact that the entire surface 64 on the back of jaws 10 is angled provides a relatively substantial undercut, and requires that the surface 64 must be machined, rather than cast. As such, the jaws 10 are relatively expensive to manufacture, difficult to inspect, and prone misalignment, leading to improper installation of fasteners. Also, due to the collet 34 having an undercut 60 for accommodating expansion of the jaws 10, the collet 34 is also relatively expensive to manufacture. The pulling head 30 is configured to be connected to a power tool having a certain stroke length to install a specific fastener. The pulling head 30 can be used with only one tool.

FIGS. 2 and 3 illustrate a prior art single jaw offset pulling head 100. Specifically, FIG. 2 provides a cross-sectional view, while FIG. 3 provides an exploded perspective view. As shown, the device provides a single jaw 14 which is biased by a spring 102 inside a drawbolt saddle 104. The jaw 14 has an angled surface 106 which engages a corresponding angled surface 108 on a drawbolt 110. The drawbolt 110 is disposed generally in a frame 112 of the pulling head 100, and a drawbolt adapter 114 is threadably engaged with the drawbolt 110. While one end 116 of the drawbolt adapter 114 is threadably engaged with the drawbolt 110, an opposite end 118 threadably engages a piston of a power tool (not shown). Likewise, one end 120 of a frame adapter 122 threadably engages the frame 112 of the pulling head 100, while an opposite end 124 of the frame adapter 122 threadably engages a head of the power tool (not shown). In addition, the pulling head 100 includes a dowel pin 126 for securing the drawbolt saddle 104 to the drawbolt 110, a roll pin 128 for facilitating sliding of the drawbolt 110 relative to the frame 112, a roll pin 129 for anchoring drawbolt saddle 104 to drawbolt 110, a guard 130 for enclosing an otherwise exposed portion of the tool 100, and a jam nut 132 for securing the pulling head 100 relative to the head of the power tool. The front end 139 of the frame 112 of the pulling head 100 has an opening 140 for receiving a stem of fastener that is desired to be installed, such that the stem can be gripped by the jaw 14 inside the pulling head 100.

In use, the pulling head 100 shown in FIGS. 2 and 3 is threadably engaged with an appropriate power tool (i.e., the end 118 of the drawbolt adapter 114 is threaded onto the piston of the power tool, the end 124 of the frame adapter 122 is threaded into the head of the power tool, and the jam nut 132 is secured down). Then, a stem of a fastener that is desired to be set is inserted into the opening 140 which is provided in the front end 139 of the frame 112. While the jaw 14 is spring biased closed by the spring 102, when the stein is inserted into the opening 140, the stem pushes the jaw 14 open and the jaw 14 springs back against the stem and becomes seated against the stein. Then, the power tool is actuated causing the piston to be pulled back, thereby pulling on the drawbolt adapter 114. Pulling on the drawbolt adapter 114 causes the drawbolt 110 and drawbolt saddle 104 to move back in the frame 112 (i.e., in a direction away from the opening 140 in the 15 front end 139 of the frame 112). Due to the fact that the jaw 14 has an angled surface 106 which engages a corresponding angled surface 108 on the drawbolt 110, movement of the drawbolt 110 in a direction away from the opening 140 in the front end 139 of the frame 112 causes the jaw 14 to grip and effectively lock on the stein of the fastener, whereby further actuation of the power tool eventually causes the stein to be pulled sufficiently such that the fastener sets and the stein breaks off.

While this system is very popular and addresses many of the limited access issues, it has some fundamental flaws. For example, the opening 140 in the frame 112, the jaw 14, and the overall stroke of the pulling head 100 shown in FIGS. 2 and 3 are all designed such that the pulling head 100 can install only one certain type of fastener. Additionally, the pulling head is expensive to maintain, and is not very reliable due to stein slippage caused by misalignment of the jaw 14. Finally, the offset pulling head 100 shown in FIGS. 2 and 3 has a relatively short tool life compared to a straight pulling head 30 such as is shown in FIG. 1.

FIG. 5 illustrates another prior art offset pulling head 200 which is commercially available. The pulling head 200 is much the same as that which is shown in FIGS. 2 and 3, except that the pulling head 200 shown in FIG. 5 has a different jaw arrangement. Specifically, while the pulling head 100 shown in FIGS. 2 and 3 includes a single jaw 14, the pulling head 200 shown in FIG. 5 has two jaws 202. The jaws 202 are retained in a collet housing 204, and a rubber sleeve 206 is glued onto the end 208 of the jaws 202. The rubber sleeve 206 tends to keep the jaws 202 relatively centered. The jaws 202 are kept closed when a stein is not inserted into an opening 210 provided in the front end 212 of the pulling head 200. An undercut 214 is provided inside the collet housing 204 to accommodate opening of the jaws 202 when a stern is inserted in the pulling head 200, and a cap 216 is threadably engaged with the collet housing 204. The cap 216 functions to compress the rubber sleeve 206 and hold the jaws 202 in place. If the cap 216 is adjusted properly, the cap 216 works to push on the rubber sleeve 206, thereby reducing its internal diameter 220 and slowing down spent stems (i.e., when a stem breaks off in the pulling head 200, the rubber sleeve 206 slows down the stem as the stem ejects back).

Disadvantages of the pulling head 200 shown in FIG. 5 include, but are not limited to the following: because the jaws 202 are kept closed and are forced open upon a stem being inserted in the opening 210 in the front 212 of the pulling head 200, there is increased wear on the jaws 202; and the undercut 214 which is provided inside the collet housing 204 to accommodate opening of the jaws 202 when a stem is inserted in the pulling head 200 makes the collet housing 214 expensive to manufacture and hard to inspect, and also reduces the overall strength of the collet housing 204, due to stress concentration. Furthermore, the capabilities of the pulling head 200 are limited to installing only the type of fastener for which the pulling head 200 is designed. The pulling head 200 is designed such that it can be used with one specific type of fastener. The pulling head 200 also has a relatively short stroke matching the intended fastener to be installed, and concentricity of the jaws 202 is controlled by the rubber sleeve 206 which is molded onto or glued onto the jaws 202, and this is unreliable. Finally, the pulling head 200 shown in FIG. 5 is expensive to manufacture and has an unreliable stem-retaining system, due to the pulling head 200 requiring accurate tightening of the rubber sleeve 206 (more specifically, the cap 216) in order to retain the spent stem—i.e., the rubber sleeve 206 works to slow down spent stems only if the cap 216 is adjusted properly. As such, failure to properly adjust pressure on the rubber sleeve 206, viz-a-viz the cap 216, can result in spent steins being ejected out of the pulling head 200 at high speed, which is a grave potential hazard.

OBJECTS AND SUMMARY

An object of an embodiment of the present invention is to provide a pulling head system which can be used in connection with a wide range of fasteners.

Another object of an embodiment of the present invention is to provide a pulling head which can be used in connection with power tools having different stroke lengths and power ratings.

Still another object of an embodiment of the present invention is to provide a set of jaws for a pulling head, where serrations of the jaws are designed such that the jaws can grip a wide range of fastener stem sizes.

Briefly, and in accordance with at least one of the foregoing objects, an embodiment of the present invention provides a pulling head system which includes a pulling head having a threaded bore at its front end and a set of nosepieces which can be threadably engaged with the threaded bore. Specifically, each of the nosepieces is configured to be used in connection with a different fastener or set of fasteners. Additionally, the pulling head has a set of internal jaws which has serrations that are configured to grip a wide range of types and size fasteners. Still further, the pulling head is configured to have a long stroke such that the pulling head can be engaged with different power tools depending on the application and what type of fastener is to be installed. In other words, the effective stroke of the pulling head is determined by the power tool to which it is engaged, rather than by the structure and design of the pulling head. Finally, preferably the pulling head has two jaws. As a result, a leading surface of the jaws need not be conical, thereby providing that the jaw component need not be machined after it is cast, providing for a very effective low cost manufacturing process.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DESCRIPTION

Figure 1:
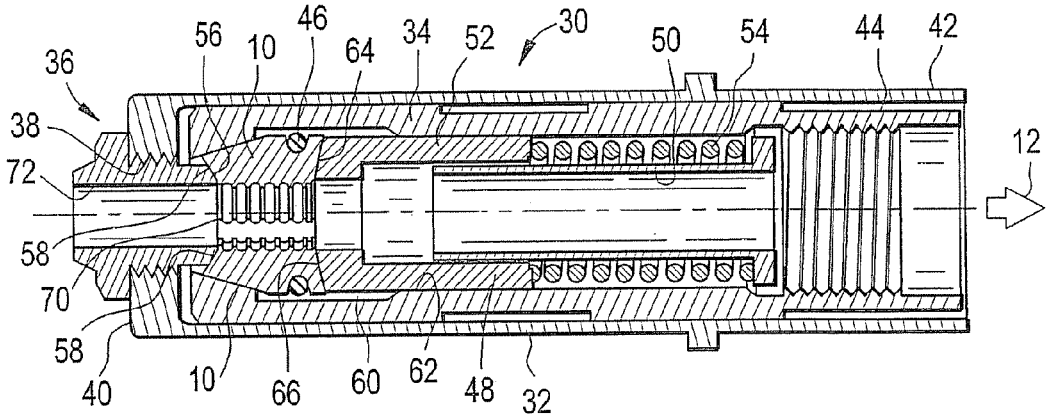
FIG. 1 is a cross-sectional view of a prior art three jaw straight pulling head.
Figure 2:
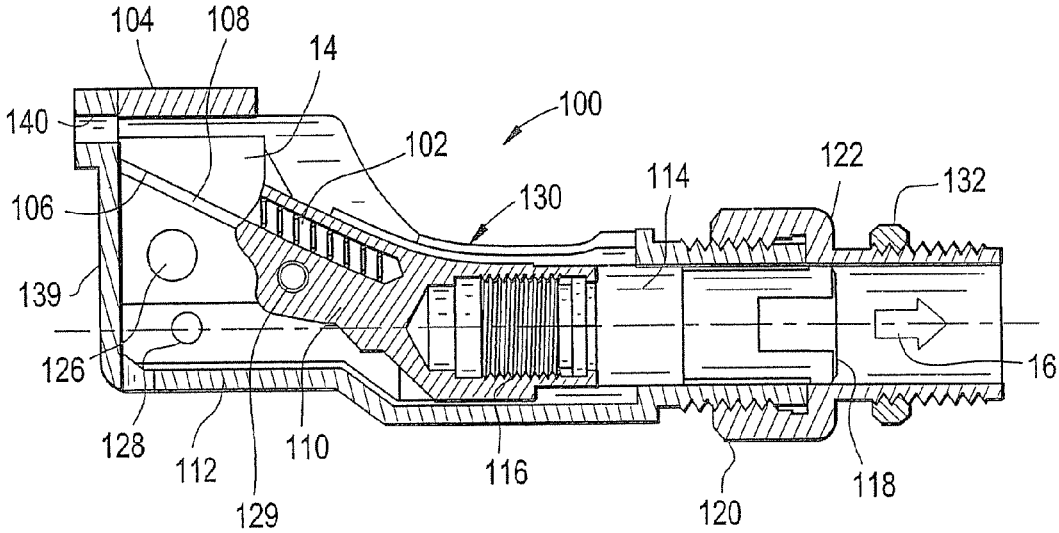
PRIOR ART FIG. 2
FIG. 2 is a cross-sectional view of a prior art single jaw offset pulling head.
Figure 3:
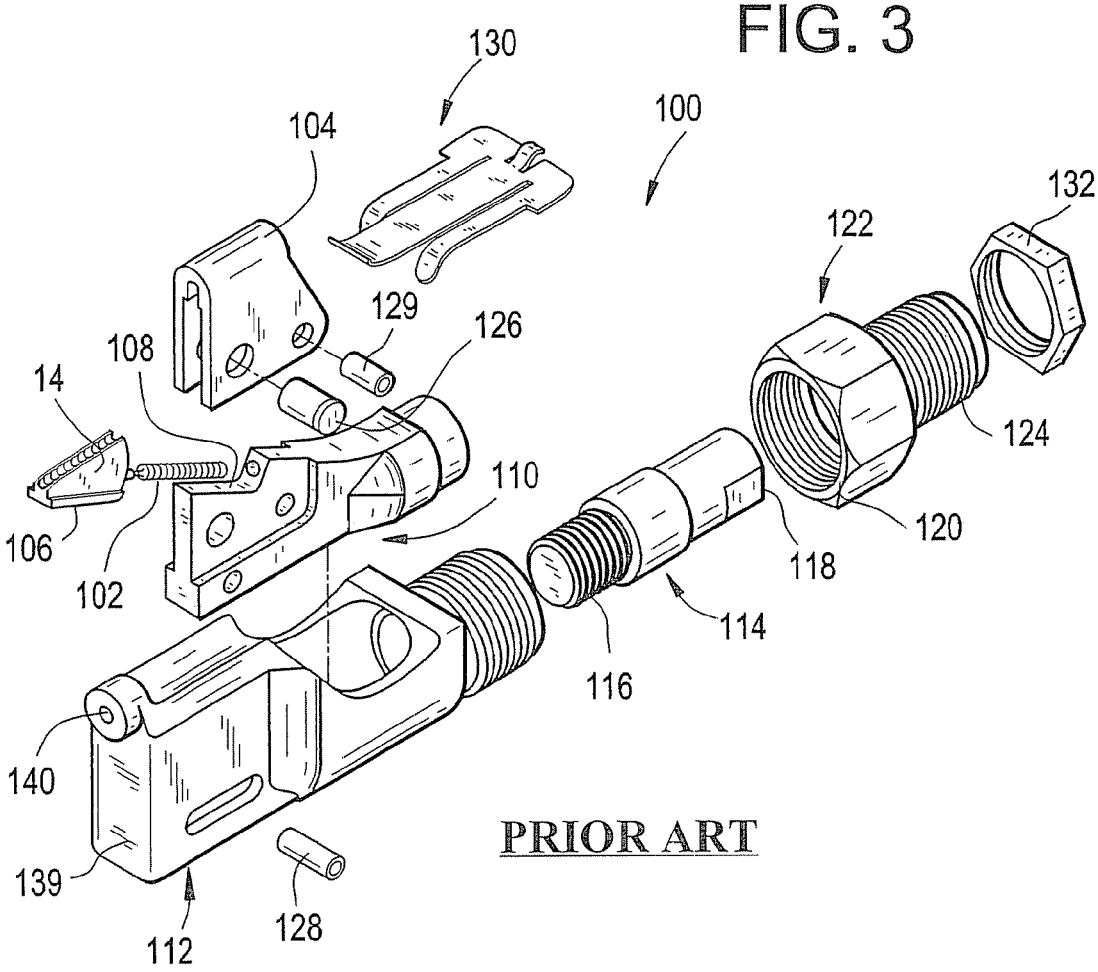
FIG. 3 is an exploded perspective view of the pulling head shown in FIG. 2.
Figure 4:
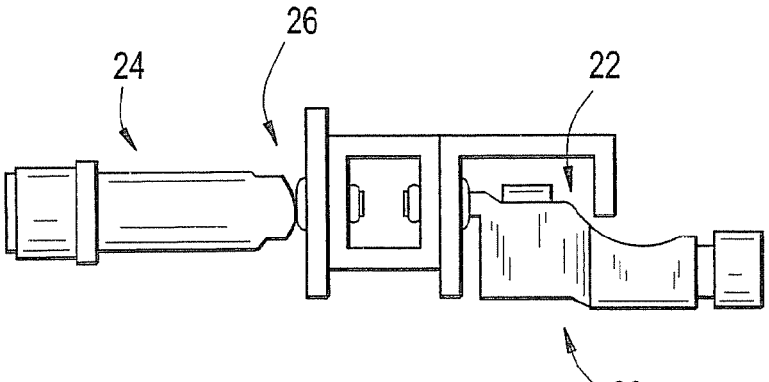
PRIOR ART FIG. 4
FIG. 4 illustrates an offset pulling head being used in an obstructed area, and a straight pulling head being used in an open access area.
Figure 5:
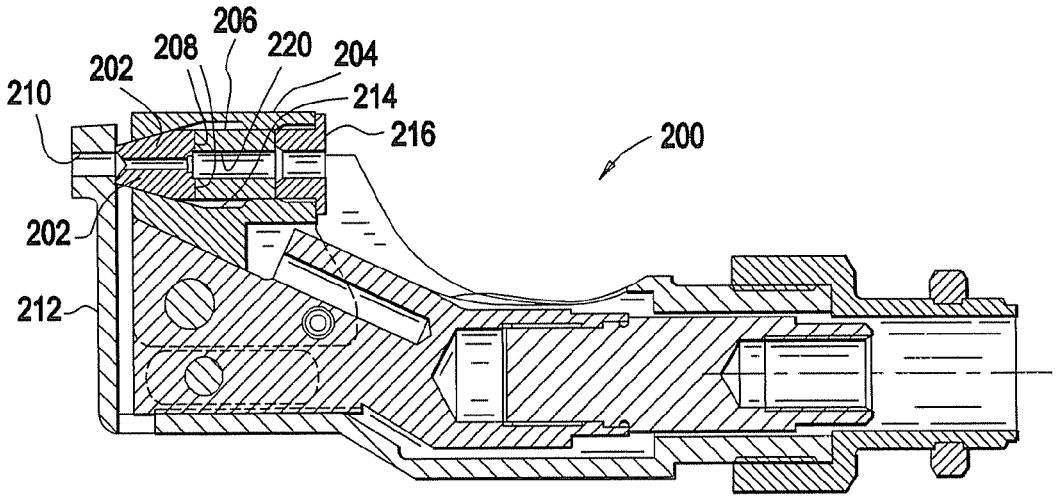
FIG. 5 is a cross-sectional view of a prior art two jaw offset pulling head.

While the present invention may be susceptible to embodiment in different forms, there are shown in the drawings, and herein will be described in detail, embodiments thereof with the understanding that the present description is to be considered an exemplification of the principles of the invention and is not intended to limit the invention to that as illustrated and described herein.

Figure 6:
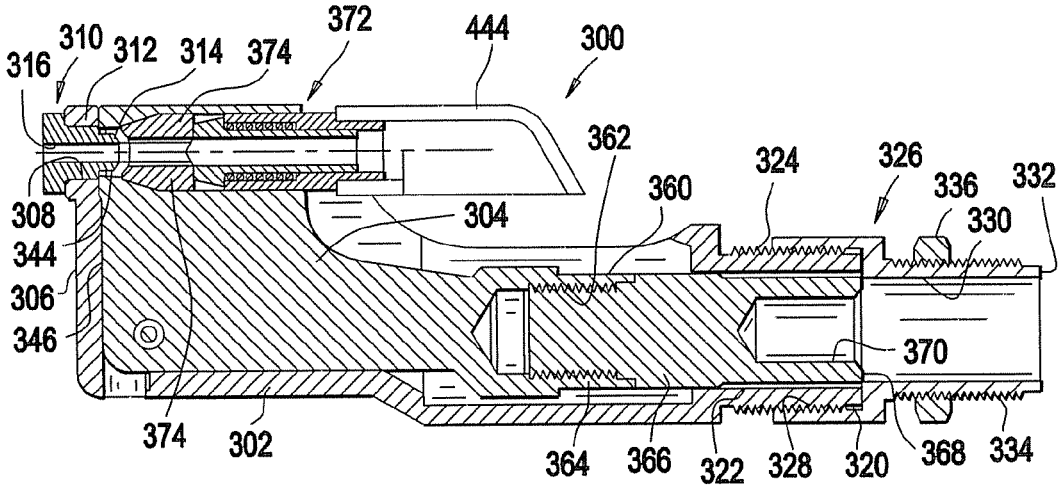
PRIOR ART FIG. 6
FIG. 6 is a cross-sectional view of an offset pulling head which is in accordance with an embodiment of the present invention.
Figure 7:
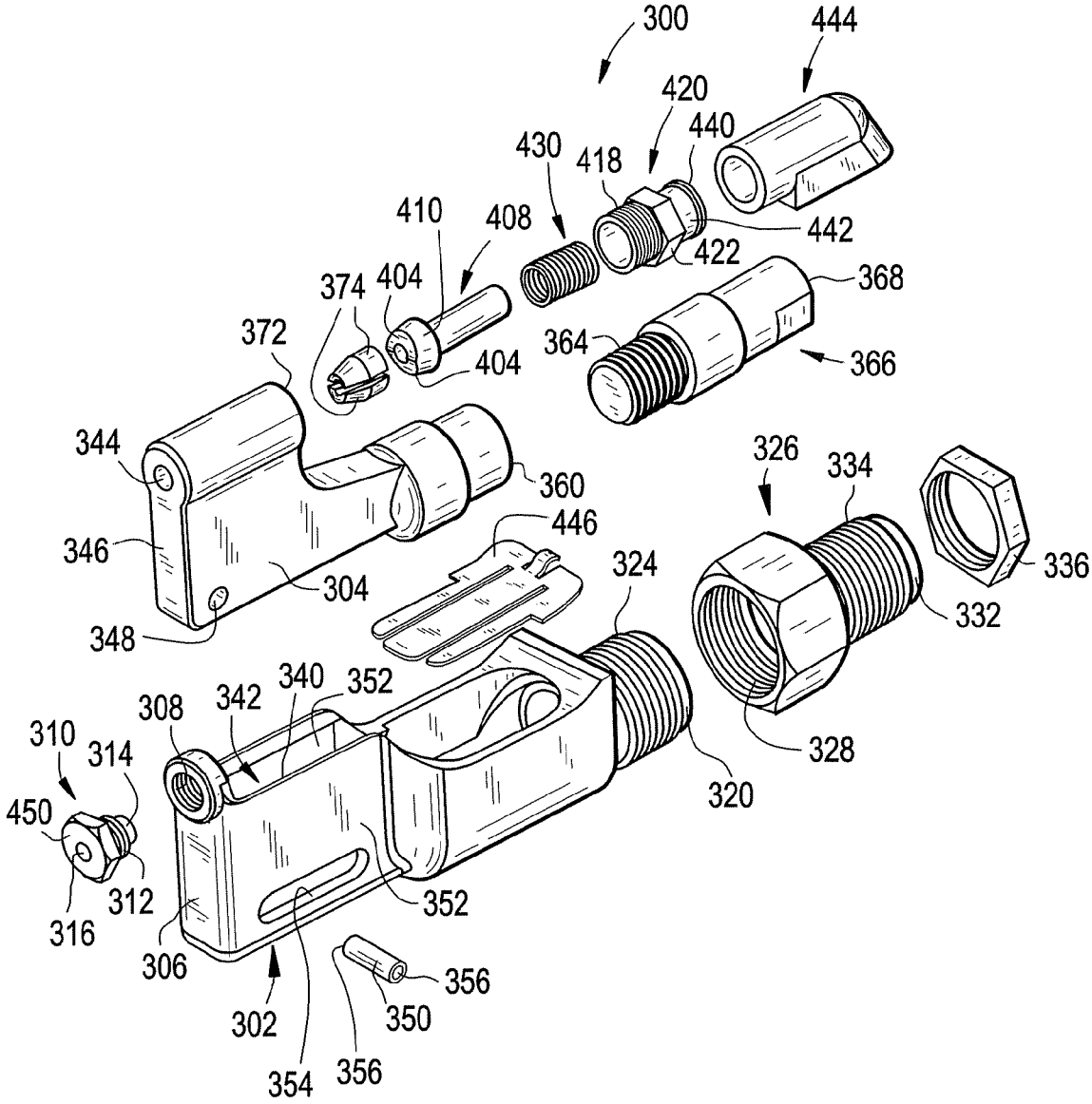
FIG. 7 is an exploded perspective view of the pulling head shown in FIG. 6.
Figure 9:
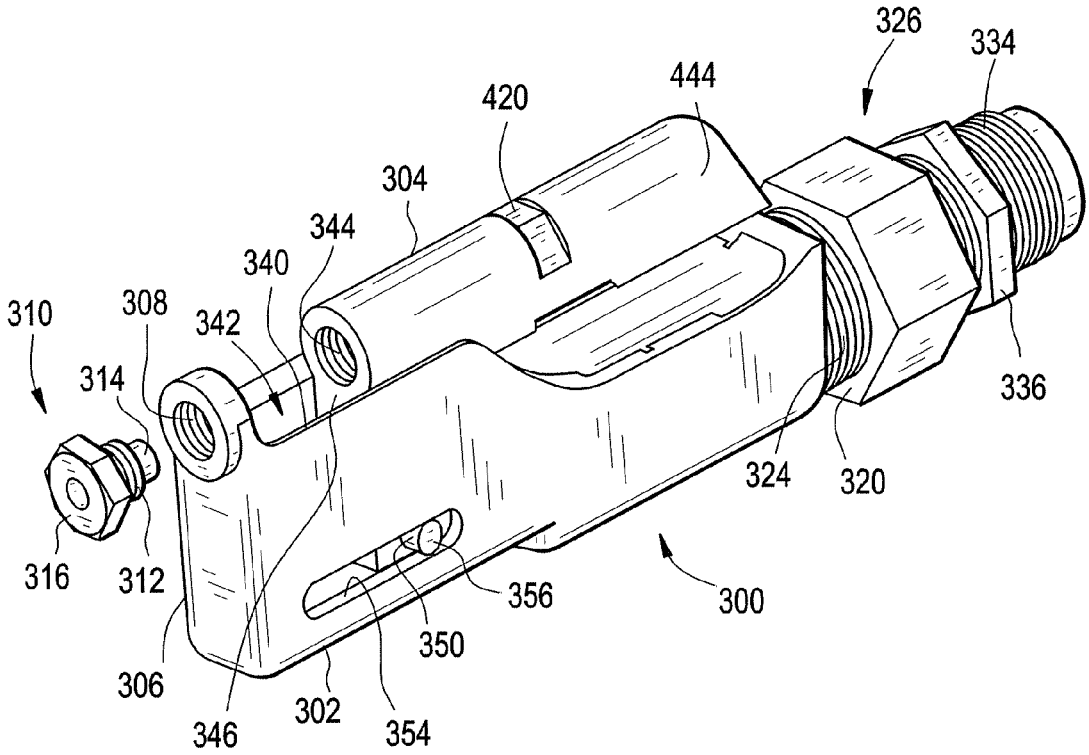
FIG. 9 is a perspective view of the pulling head shown in FIG. 6, showing the nosepiece removed.

An embodiment of the present invention is shown, for example, in FIGS. 6, 7 and 9. The embodiment is a pulling head 300 which is configured for engagement with a power tool. Once engaged with a power tool, the stem of a fastener can be inserted in a front of the pulling head 300, and the power tool actuated. This causes the pulling head 300 to pull on the stem, causing the fastener to set and the stem of the fastener to eventually break off. The pulling head 300 can be used in connection with a wide range of fasteners, and can be used in connection with power tools having different stroke lengths and/or power ratings.

As shown in FIGS. 6 and 7, the pulling head 300 includes a frame 302 (preferably formed of ultra-high-strength stainless steel), and inside the frame 302 sits a drawbolt or carrier 304 (preferably formed of an ultra-high-strength alloy). Preferably, the frame 302 has a long, thin front end 306 for access in hard to reach, tight areas, and at the front end 306 of the frame 302 is a threaded bore 308 for threadably receiving a nosepiece 310. As shown in FIGS. 6-9, the nosepiece 310 has a corresponding externally threaded surface 312 which is configured to thread into the threaded bore 308 which is provided in the front end 306 of the frame 302. The nosepiece 310 also includes a portion 314 which extends from this externally threaded portion 312, and a throughbore 316 which is configured to receive the stem of a fastener, as will be described in more detail hereinbelow.

The back end 320 of the frame 302 has a bore 322 and a threaded exterior surface 324 for threadably engaging an adapter 326. The adapter 326 includes a corresponding internally threaded bore 328 for threading onto the threaded exterior surface 324 of the frame 302. The adapter 326 also has a throughbore 330, and an opposite end 332 of the adapter 326 has an externally threaded surface 334 for threadably engaging with a jam nut 336 and the frame of an appropriate power tool, such as power tool model numbers G902, G746, G704 and G747, currently commercially available from Cherry Aerospace LLC. Once the power tool is threaded onto the adapter 326, the jam nut 336 is used to effectively lock the pulling head 300 arid the power tool together.

The frame 302 of the pulling head 300 has a top surface 340 which is effectively open and the carrier 304 generally sits in this open area 342. As will be described more fully later hereinbelow, the carrier 304 is slidable back in the frame 302 (i.e., away from the threaded bore 308 provided in the front end 306 of the frame 302) upon actuation of the power tool, and is slidable forward in the frame 302 (i.e., toward the threaded bore 308 provided in the front end 306 of the frame 302) upon a return stroke of the power tool. The carrier 304 has an opening 344 in its front end 346 which generally aligns with the threaded opening 308 which is provided in the front end 306 of the frame 302. The carrier 304 also has a cross-bore 348 which is configured to receive a pin 350. The frame 302 includes sidewalls 352 which effectively define the open area 342 in which the carrier 304 sits, and a long slot 354 is provided in each of the sidewalls 352. Each of the slots 354 is configured to receive a respective end 356 of the pin 350. As such, the stroke of the pulling head 300 (i.e., movement of the carrier 304 relative to the frame 302) is guided by the pin 350 riding in the slots 354 which are provided in the sidewalls 352 of the frame 302.

A rear end 360 of the carrier 304 includes an internally threaded bore 362 which is configured to receive an externally threaded end portion 364 of a drawbolt adapter 366. The opposite end 368 of the drawbolt adapter 366 has an internally threaded surface 370 for threading onto a piston of a power tool. As such, when the power tool is actuated, the power tool pulls on the drawbolt adapter 366 and hence also the carrier 304. The carrier 304 includes a chamber 372 which effectively communicates with the opening 344 which is provided in the front 346 of the carrier 304. Inside the chamber 372 is disposed a set of two jaws 374.

Figure 8:
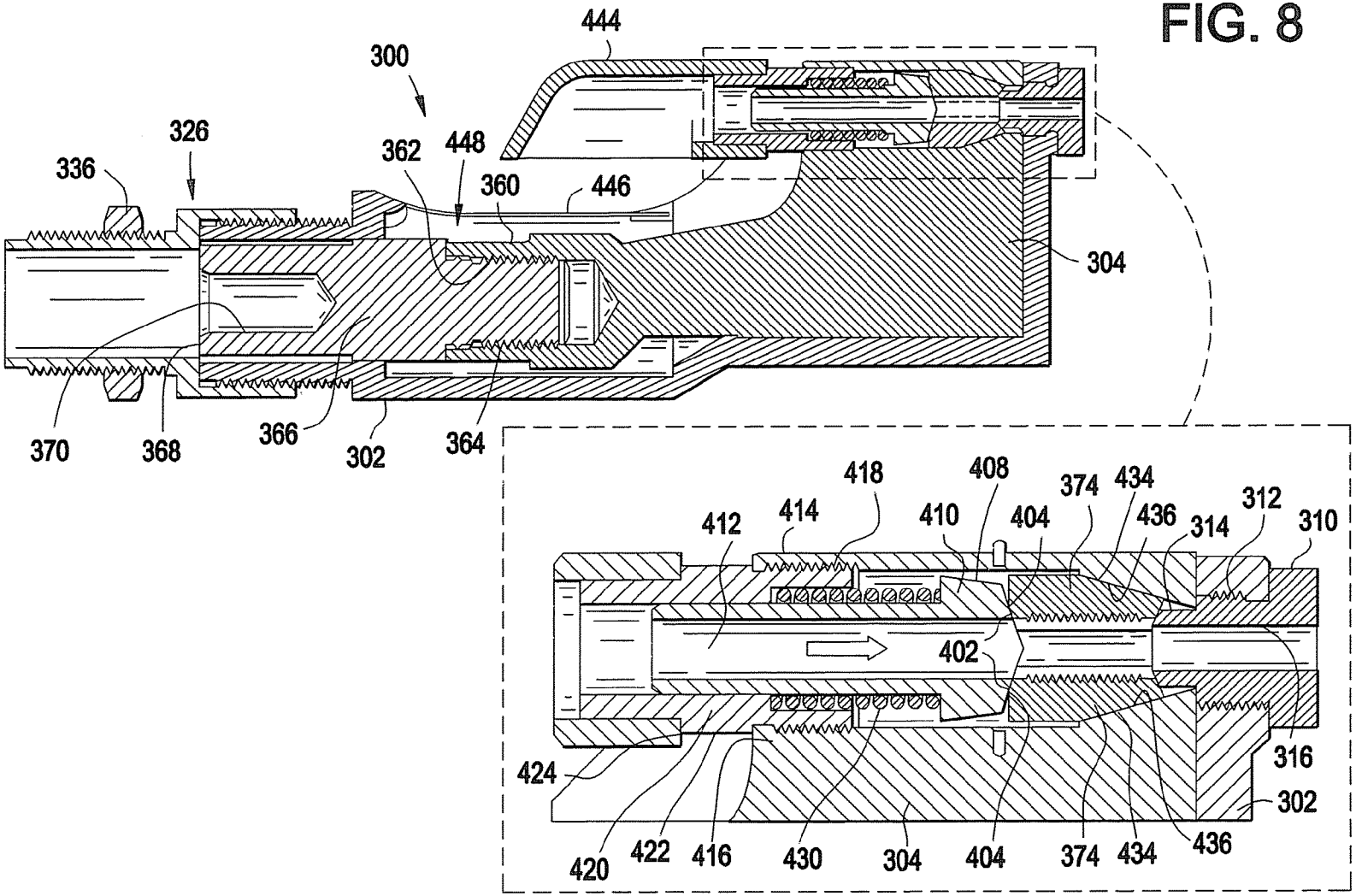
FIG. 8 shows an enlarged view of a portion of the pulling head shown in FIG. 6.
Figure 12:
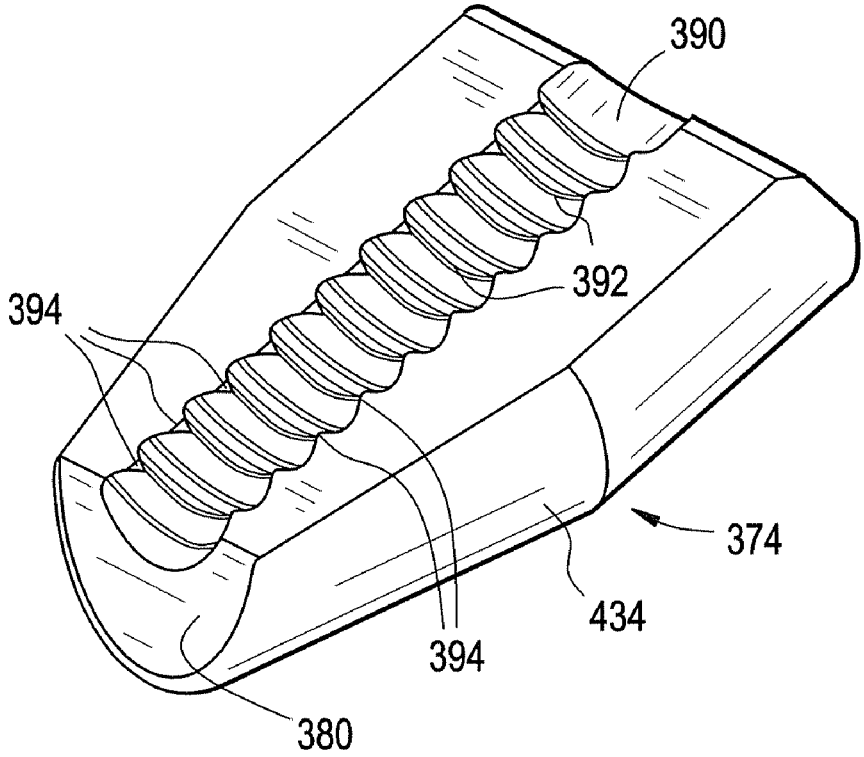
FIG. 12 is a perspective view of one of the jaws of the pulling head.
Figure 15:
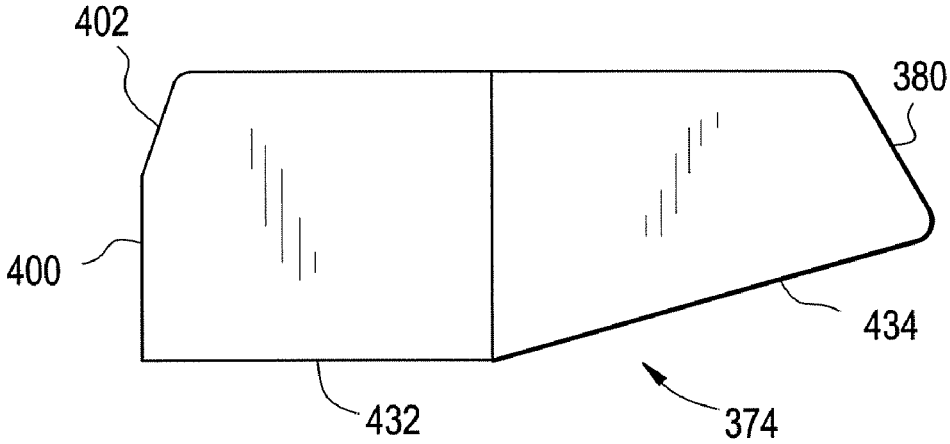
FIG. 15 is a side view of one of the jaws.

As shown in FIGS. 12 and 15, each of the jaws 374 has a tapered leading edge 380 which is configured to engage a corresponding angled end surface 382 of the nosepiece 310, as shown in FIG. 8. This engagement tends to keep the jaws 374 opened and centered when the pulling head 300 (i.e., the power tool) is not being actuated. As a result, when the stem 384, 484 of a fastener 386, 486 is initially inserted into the nosepiece 310, 310*a* as shown in either FIG. 17 or FIG. 21, the stem 384, 484 need not force the jaws 374 open. This results in avoiding unnecessary wear on the jaws 374.

Figure 13:
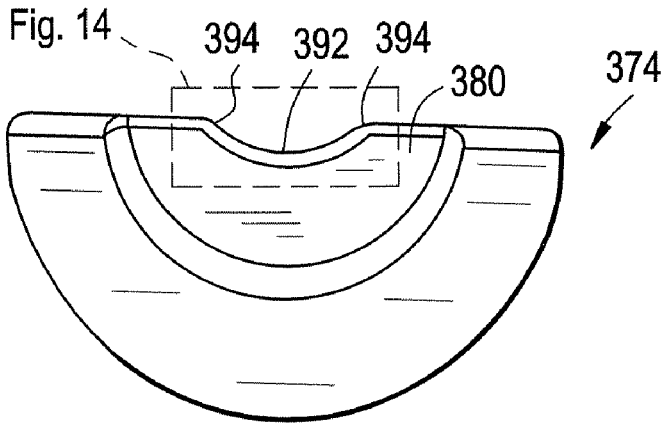
FIG. 13 is a front view of one of the jaws of the pulling head.
Figure 14:
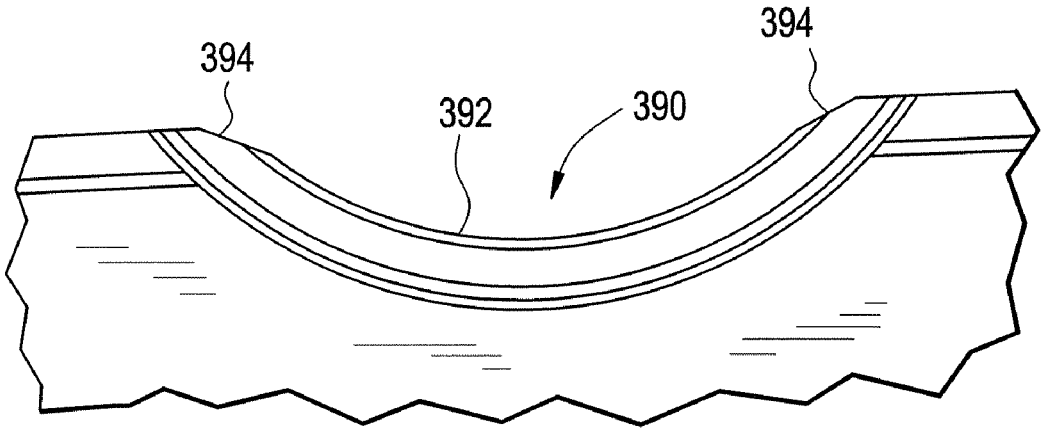
FIG. 14 is an enlarged view of a portion of the jaw.

As shown in FIG. 12, each of the jaws 374 has an internal surface 390 which is serrated. The serrations 392 are configured such that they can grip a wide range of size fastener stems. Specifically, as shown in FIGS. 12-14, each of the serrations 392 has angled end portions 394 which allow bigger size sterns to be inserted into the jaws 374 without weakening or causing unnecessary wear on the jaws 374. In other words, the back end 384 of the nosepiece 310 tends to spread the jaws 374 open, and once the jaws 374 are open, the fact that the serrations 392 have angled end portions 394 allows the jaws 374 to receive a larger range of stern sizes before the stem rubs up against the serrations 374 as the stem is being inserted into the pulling head 300, through the nosepiece 310. The tapered leading edge 380 of each of the jaws 374 (see FIG. 15) also helps to lead in a stem as the stem is initially inserted through the nosepiece 310 into the jaws 374.

As shown in FIG. 15, an opposite end 400 of the jaws 374 also provides a tapered surface 402, and this tapered surface 402 is configured to engage a corresponding beveled surface 404 which is provided on the end 406 of a jaw follower 408. This engagement tends to keep the jaws 374 accurately positioned in the chamber 372 of the carrier 304. The jaw follower

408 includes a head portion 410 which provides the beveled surfaces 404, and a throughbore 412 which extends through the middle of the jaw follower 408. As will be described more fully later hereinbelow, this throughbore 412 is provided so that spent stems 384, 484 can travel through the pulling head 300.

The fact that two jaws 374 are provided in the pulling head 300 rather than three or more, allows the front surface 406 of the jaw follower 408 to be provided as having two beveled surfaces 404 rather than a full conical surface. As such, only a portion (402) of the rear surfaces 400 of the jaws 374 need to be angled. As a result, there is no large undercut, and the jaws 374 can be cast, as opposed to having to be machined. Therefore, the jaws 374 are significantly less expensive to manufacture.

As shown in FIGS. 6-8, a rear end 414 of the chamber 372 which is provided in the carrier 304 has an internally threaded surface 416 for threadably receiving a corresponding externally threaded surface 418 which is provided on a plug member 420. Preferably, another portion 422 of the external surface 424 of the plug member 420 provides a surface profile, such as a hexagon surface, which allows a hand tool to be engaged with the plug member 420 so that the plug member 420 can be easily threaded into the carrier 304.

Disposed between the plug member 420 and the head 410 of the jaw follower 408 is a compression spring 430. The compression spring 430 works to spring bias the jaw follower 408 toward the jaws 374. An external surface 432 of each of the jaws 374 has an angled surface 434 which generally engages a corresponding angled surface 436 inside the chamber 372 of the carrier 304. As shown in FIG. 6, the chamber 372 in the carrier 304 is not provided as having any type of undercut for accommodating expansion of the jaws 374, because an undercut is not needed. The engagement between the angled surfaces 434 on the jaws 374 and the internal angled surface 436 in the carrier 304, and the fact that a compression spring 430 is provided, all tends to cause the jaws 374 to be normally closed when the pulling head 300 is not be actuated. However, as discussed above, the tapered leading edge 380 of the jaws 374 engages the back 382 of the nosepiece 310. As such, the jaws 374 are spring biased toward the front 306 of the pulling head 300, but are held open a pre-determined distance by the nosepiece 310.

An opposite end 440 of the plug member 420 has an exterior surface 442 which is configured to engage a pin or stem deflector 444 (which is preferably elastic). Alternatively, a vacuum hose may be engaged with end 440 of the plug member 420 such that spent stems are effectively suctioned out of the pulling head 300. As shown in FIGS. 6 and 7, a guard 446 may be provided for covering an external area 448 of the pulling head 300 which would otherwise be left generally exposed. The plug member 420 not only works to hold the stem deflector 444, but also to accurately guide the jaw follower 408.

Figure 10:
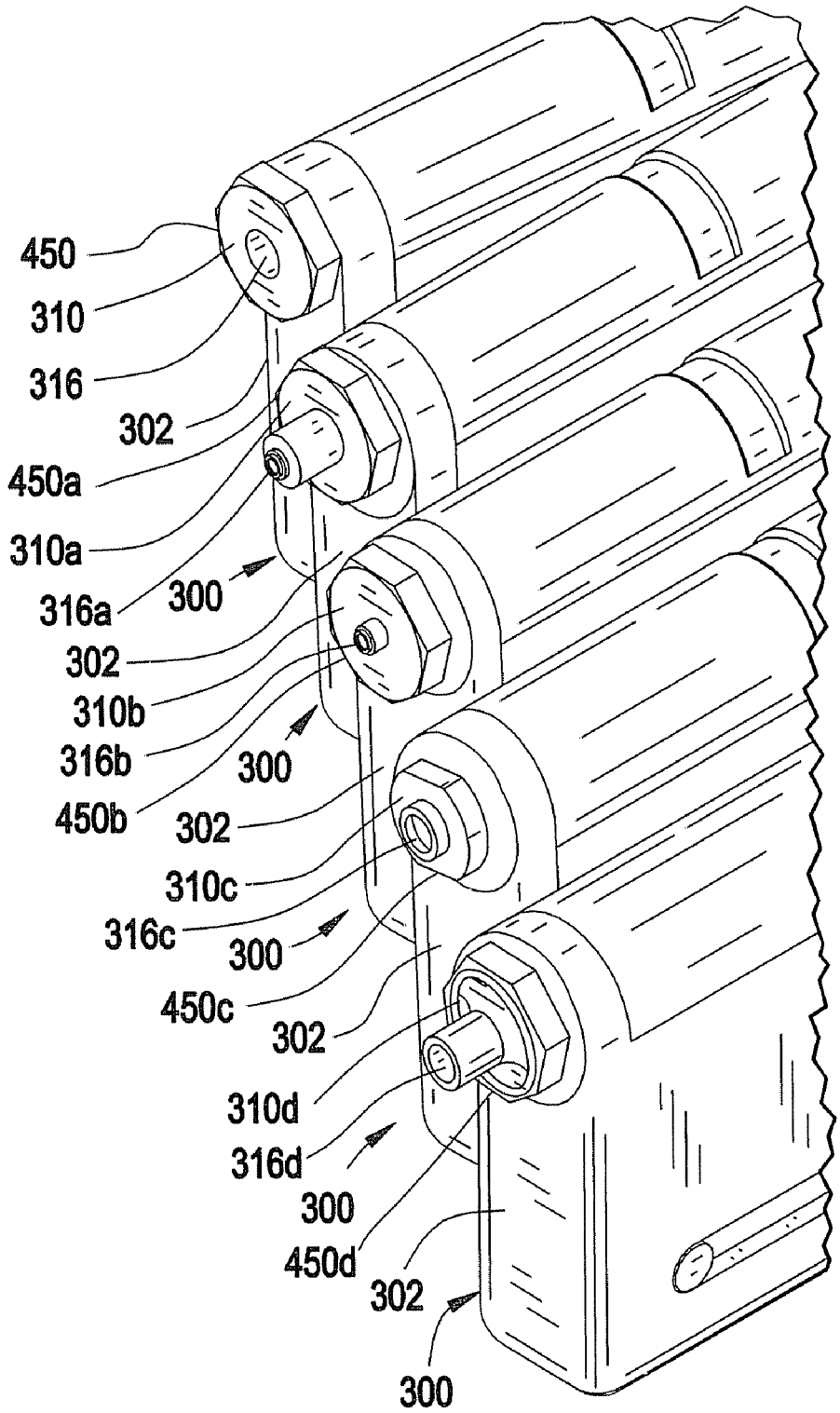
FIG. 10 shows a set of nosepieces that can be engaged with the pulling head.

As discussed above, the front end 306 of the frame 302 of the pulling head 300 provides a threaded bore 308 which is configured to threadably receive a nosepiece 310. More specifically, as shown in FIG. 10, preferably the pulling head 300 is provided as a system which includes a plurality of nosepieces, 310, 310*a*, 310*b*, 310*c*, 310*d* where each of the nosepieces is different. Specifically, preferably each nosepiece 310, 310*a*, 310*b*, 310*c*, 310*d* is configured for receiving a different size fastener stem (or range of sizes). To this end, each nosepiece 310, 310*a*, 310*b*, 310*c*, 310*d* has a different size internal bore 316, 316*a*, 316*b*, 316*c*, 316*d* and/or a different length of rear portion (i.e., 314 in FIGS. 6 and 7 (as such, each nosepiece opens the jaws to a different pre-determined extent) arid/or a different front surface profile 450, 450*a*, 450*b*, 450*c*, 450*d* for setting different fasteners.

Figure 11:
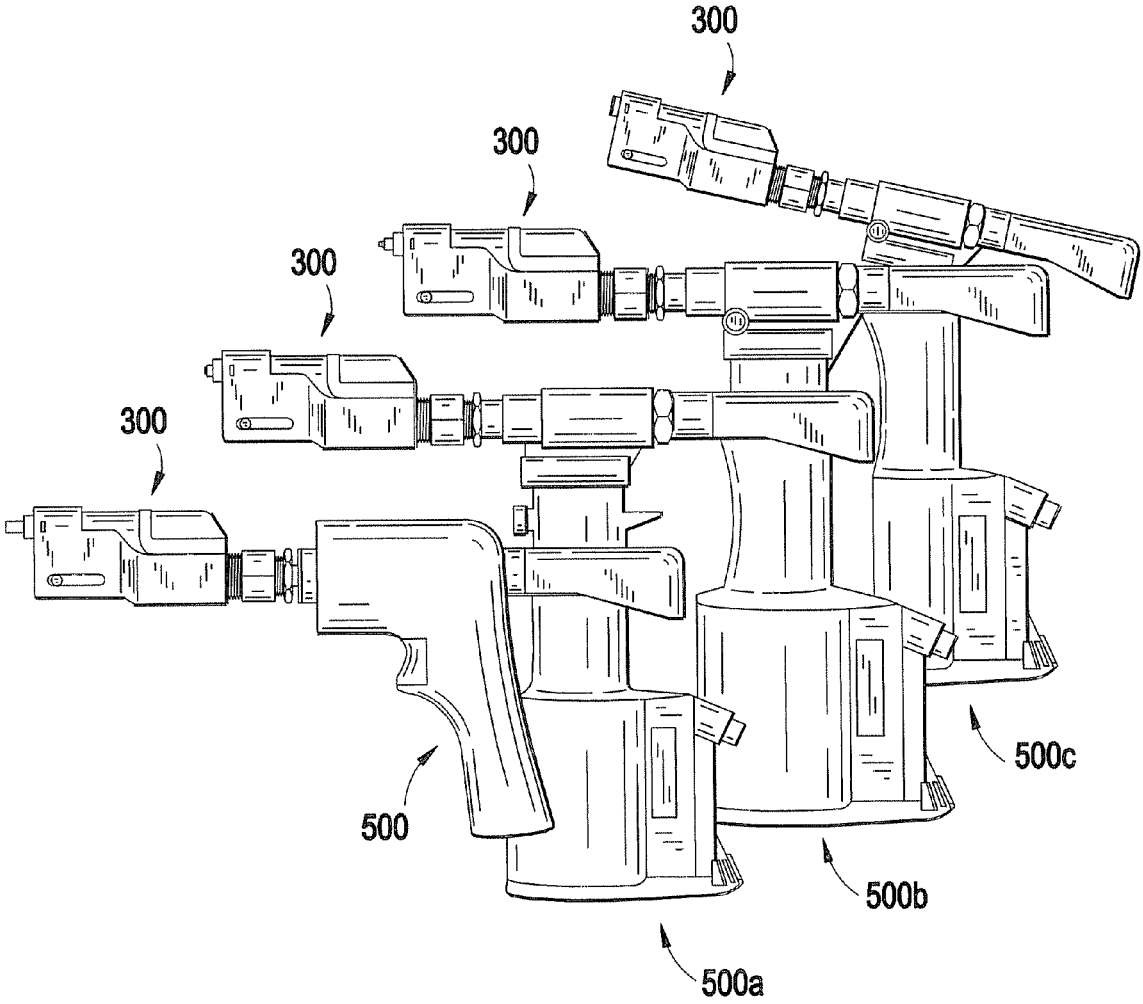
FIG. 11 shows how the pulling head can be engaged with a range of different power tools, each having a different stroke and/or power rating.

Furthermore, the slots 354 on the frame 302 of the pulling head 300 are long enough that the stroke of the pulling head 300 is not effectively constrained. As such, as shown in FIG. 11, the pulling head 300 can be engaged with several different power tools 500, 500*a*, 500*b*, 500*c* each having a different stroke length and/or power rating, depending on the what type of fastener is to be installed. For example, the pulling head 300 can be connected to a G902 riveter having a three-quarter inch stroke and a power rating of 730 pounds, a G746 riveter having a 0.875 inch stroke and a power rating of 1850 pounds, a G704 riveter having a half inch stroke and a power rating of 3100 pounds, or a G747 riveter having a 7/16 inch stroke and a power rating of 2100 pounds, each of which is commercially available from the assignee of the present invention.

By providing a set of nosepieces 310, 310*a*, 310*b*, 310*c*, 310*d* with the pulling head 300 (such as is shown in FIG. 10), and the fact that the serrations 392 of the jaws 374 have angled end surfaces 394 (see FIGS. 12-14), the pulling head 300 can be used with a very wide range of fasteners. All a user has to do is select the correct nosepiece (i.e., one of 310, 310*a*, 310*b*, 310*c* or 310*d*) for the application, install that nosepiece on the frame 302 of the pulling head 300, and then attach the pulling head 300 to the correct power tool (i.e., one of 500, 500*a*, 500*b*, 500*c*), depending on the application (i.e., depending on stroke and power requirements).

Figure 19:
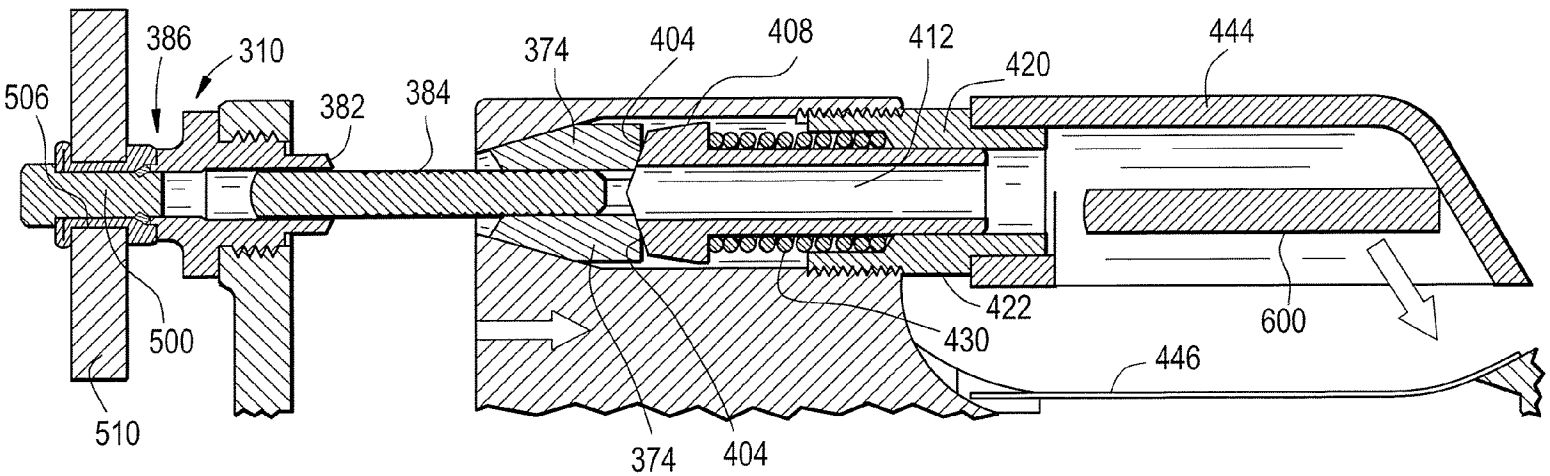
Figure 20:
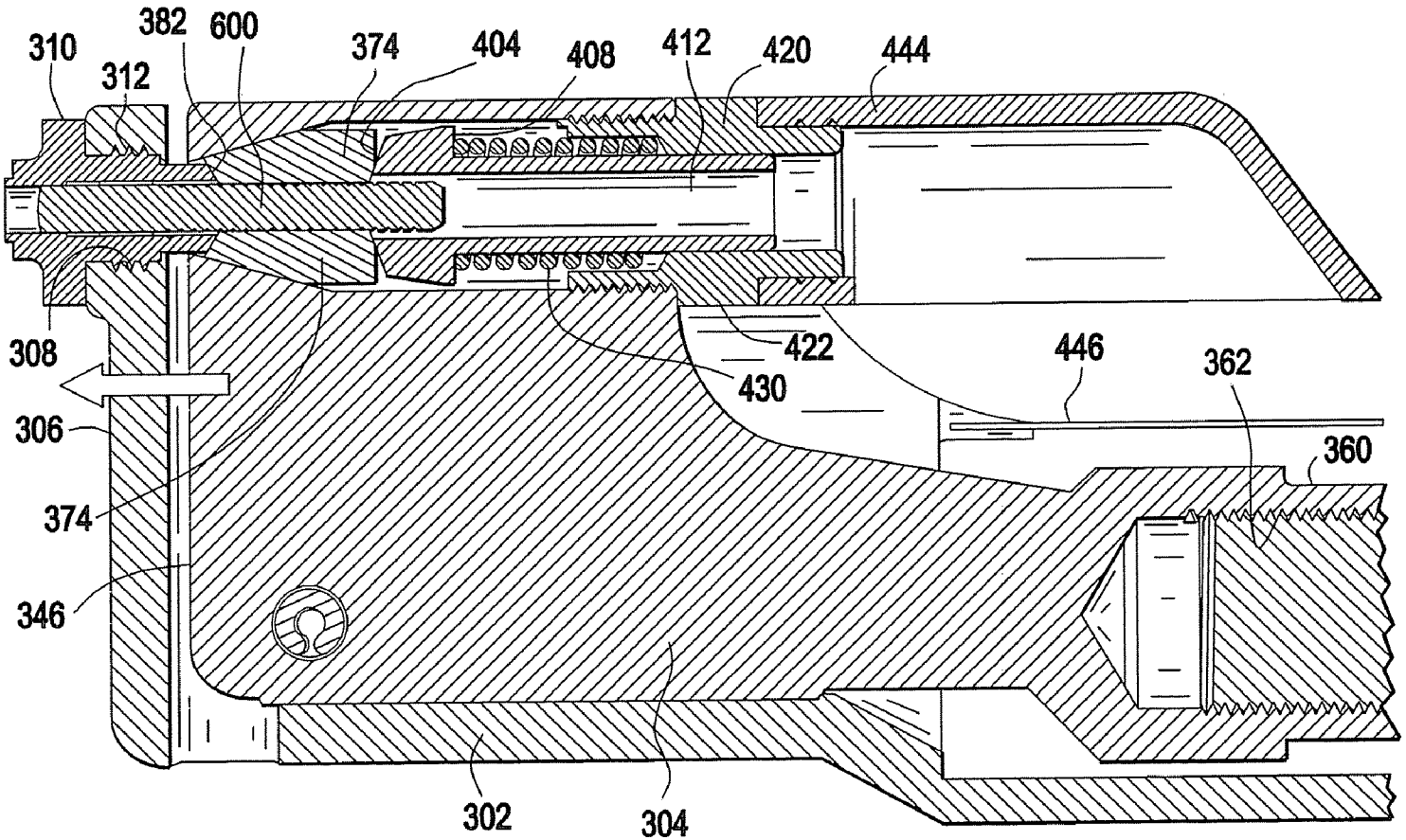
Figure 21:
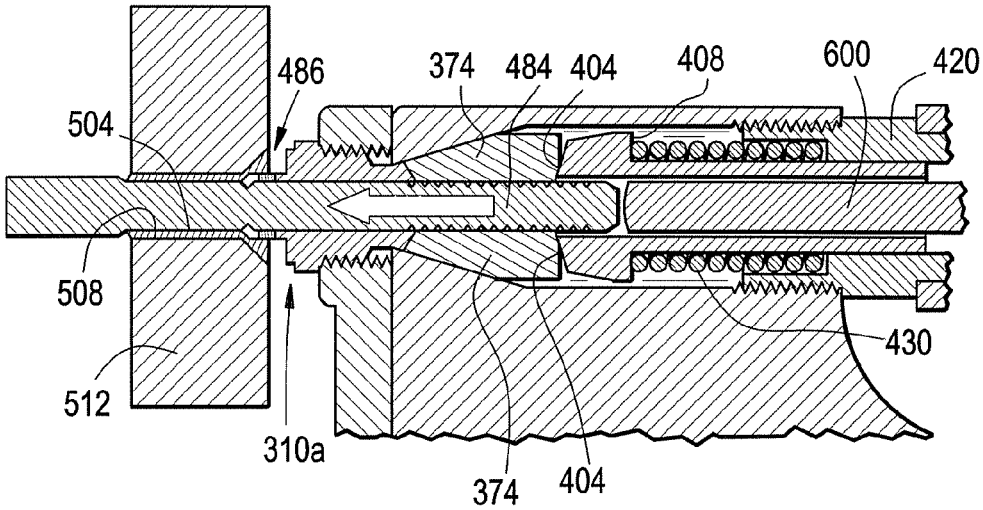
FIGS. 21-23 show the pulling head being used to install a much smaller type of fastener, specifically an "A" code Cherrylock® rivet, commercially available from the assignee of the present invention, and requiring lower installation loads and a relatively long stroke.
Figure 22:
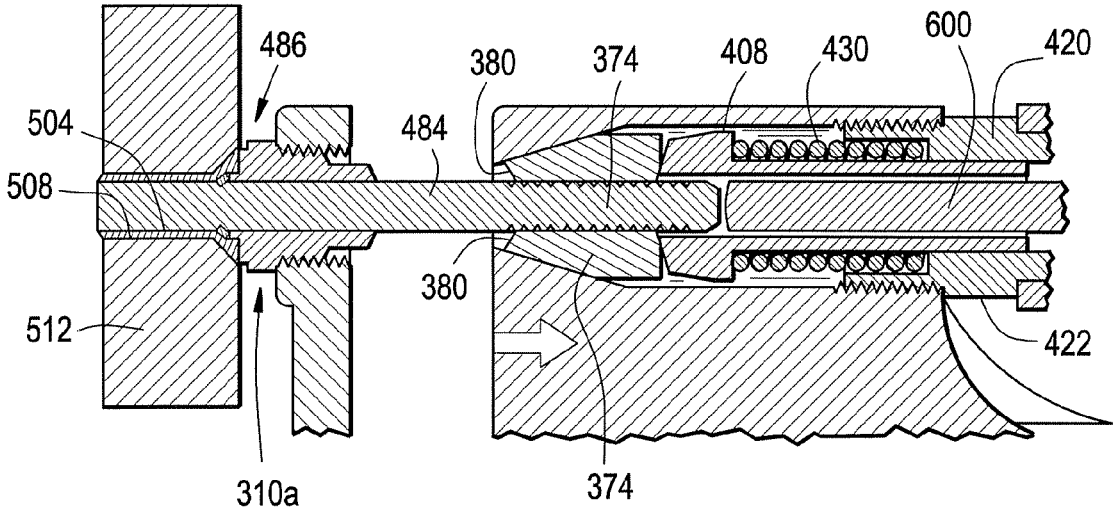
Figure 23:
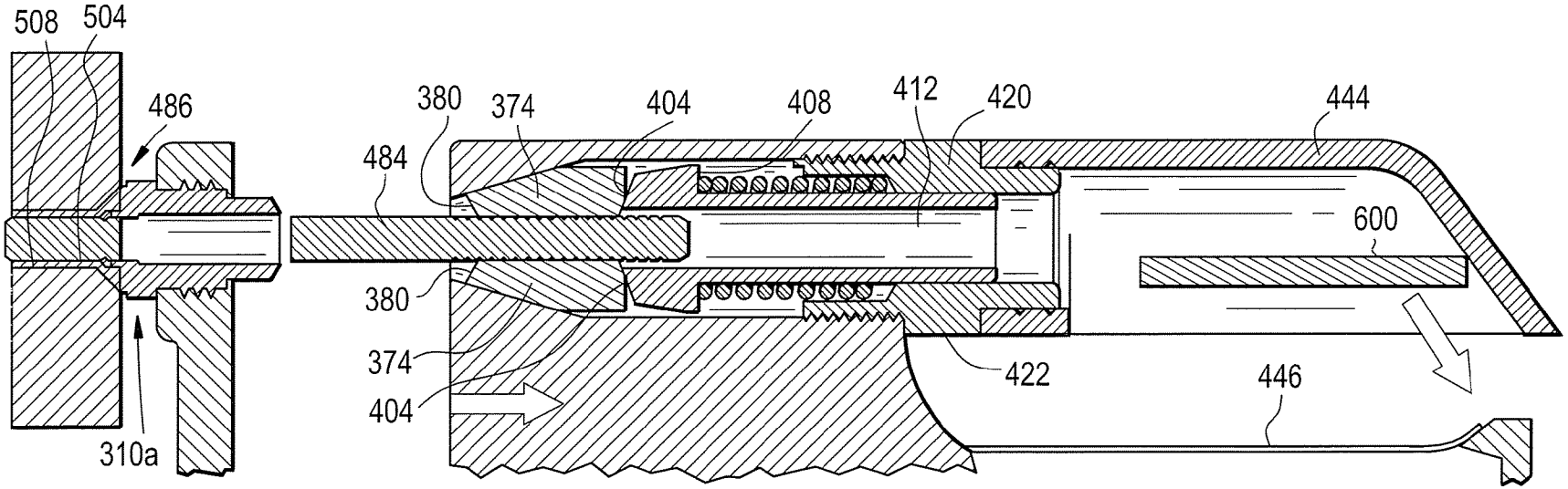

For example, while FIGS. 16-20 show the pulling head 300 being used to install a large, "U" type blind bolt 386 (requiring a high installation load and a relatively short stroke), FIGS. 21-23 show the pulling head being used to install a much smaller type of fastener, specifically an "A" code Cherrylock® rivet 486 (requiring a low installation load and a relatively long stroke), commercially available from the assignee of the present invention. Regardless, the pulling head 300 operates effectively the same.

To assemble the pulling head 300, the jaws 374 are inserted into the chamber 372 of the carrier 304, the jaw follower 408 is inserted in the spring 430, and the jaw follower 408 and spring 430 are inserted into the chamber 372. Then, the plug 420 is threaded into the carrier 304, and the stem deflector 444 is engaged with the plug 420 (alternatively, a vacuum extraction system can be used, as discussed above). Then, the carrier 304 is inserted into the surface opening 342 in the frame 302 and the drawbolt adapter 366 is inserted into the rear end 320 of the frame 302 and is threaded into the end 360 of the carrier 304. Subsequently, the frame adapter 326 is threaded onto the end 320 of the frame 302, and the jam nut 336 is threaded onto the drawbolt adapter 326.

Depending on what type of fastener is going to be installed using the pulling head 300, the appropriate nosepiece 310, 310*a*, 310*b*, 310*c*, 310*d* is chosen (see FIG. 10) and threaded into the front 306 of the frame 302, and then the pulling head 300 is engaged with the appropriate power tool 500, 500*a*, 500*b*, 500*c* (see FIG. 11). Finally, the jam nut 336 is rotated in order to effectively lock the pulling head 300 on the power tool.

As discussed above, while FIGS. 16-20 show the pulling head 300 being used to install a large, "U" type blind bolt 386, which requires a high installation load and a relatively short stroke, FIGS. 21-23 show the pulling head 300 being used to install a much smaller type of fastener 486, specifically an "A" code Cherrylock® rivet, which requires a low installation load and a relatively long stroke. While different nosepieces and power tools are selected for these two applications, the pulling head operates effectively the same during fastener installation.

Figure 16:
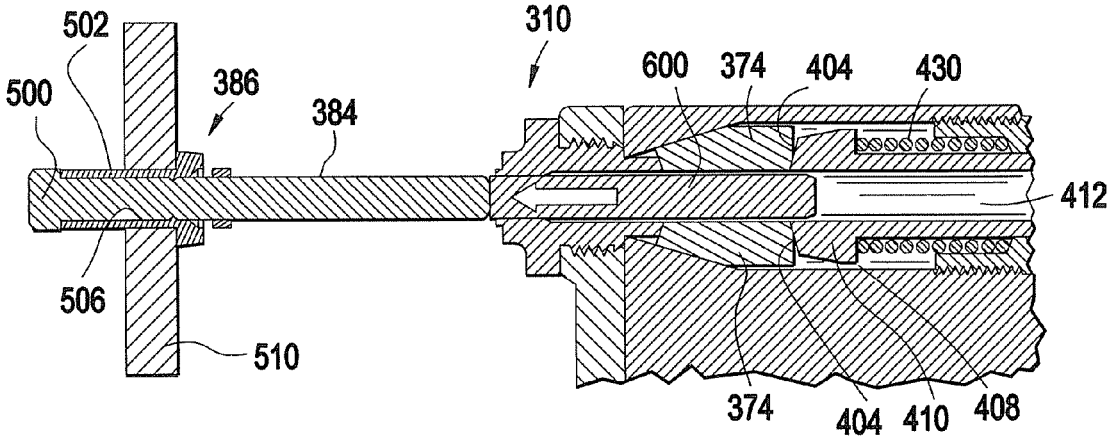
FIGS. 16-20 show the pulling head being used to install a large, "U" type blind bolt, requiring high installation loads and a relatively short stroke.
Figure 17:
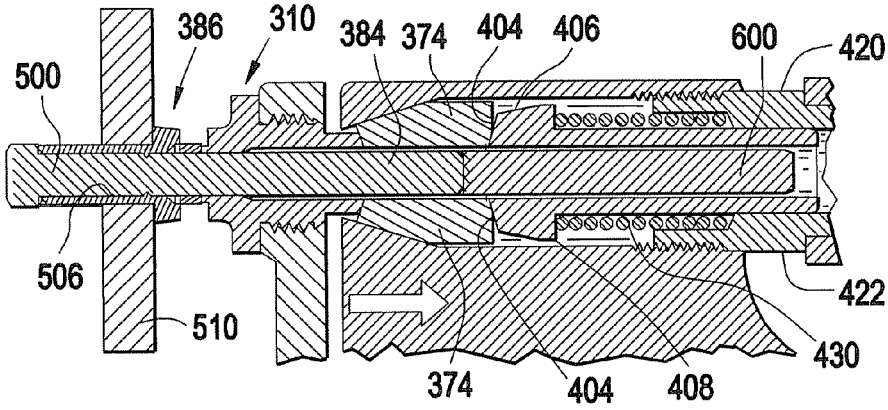
Figure 18:
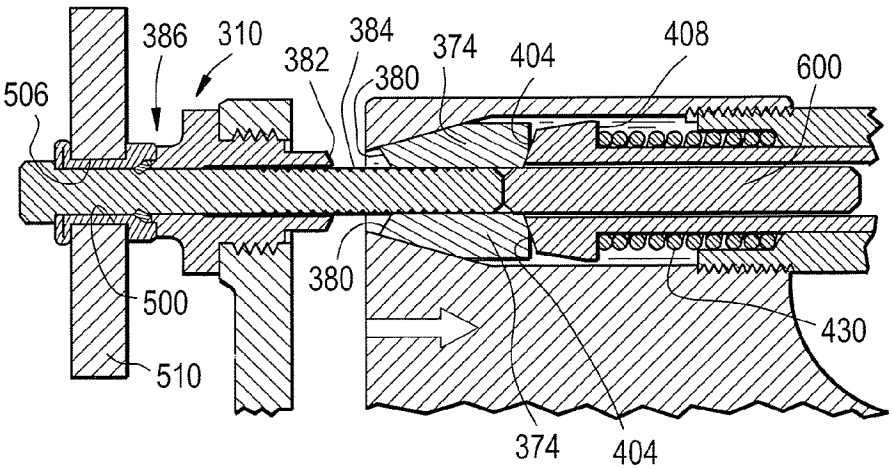

In use, the stem 384, 484 of a fastener 386, 486 is initially inserted into the nosepiece (while a sleeve 502, 504 of the fastener 386, 486 is positioned in an aperture 506, 508 provided in a workpiece 510, 512) (see FIGS. 16 and 17, or FIG. 21). Specifically, the stem 384, 484 is inserted through the nosepiece 310, such that the stem 384, 484 extends between the jaws 374. If a spent stern (identified with reference numeral 600) is sitting in the pulling head 300 at the time, the new stein 384, 484 pushes the spent stem 600 back further into the pulling head 300, into the jaw follower 408. When the new stem 384,484 is initially inserted into the nosepiece 310, the jaws 374 are being held open by the nosepiece 310, and tend to be centered by both the nosepiece 310 and the front surface 404 of the jaw follower 408 (see FIG. 8 which shows in detail the engagement of each end of the jaws 374 with the jaw follower 408 and nosepiece 310). As discussed above, the fact that the jaw serrations 392 have angled surfaces 394, as shown in FIGS. 12-14, allows the jaws 374 to receive a larger range of steins before being frictionally contacted by a stem upon insertion. Once the nosepiece 310 is brought into contact with the sleeve 506, 508 of the fastener 386, 486, as shown in FIG. 17 or FIG. 21, and the stem 384, 484 extends through the nosepiece 310, between the jaws 374, the power tool (and therefore the pulling head 300) is actuated. As shown in FIG. 17 or FIG. 22, actuation of the power tool causes the carrier 304 to slide back in the frame 302 of the pulling head 300, generally away from the nosepiece 310. This movement (and action of the compression spring 430) causes the jaws 374 to slide forward in the chamber 372 of the carrier 304, resulting in the jaws 374 gripping the stein 384, 484. Further actuation of the power tool (i.e., 500, 500*a*, 500*b* or 500*c* in FIG. 1) causes further sliding of the carrier 304 within the frame 302, causing the fastener 386, 486 to set as shown in FIG. 18 (FIG. 22 also shows fastener 486 after it has set), and even further actuation of the power tool causes further sliding of the carrier 304 within the frame 302, causing the stein 384, 484 to break off as shown in FIG. 19 or FIG. 23. The inertia caused by the break impact causes any spent stem 600 which may be sitting in the pulling head 300 (i.e., any stein 384, 484 which broke off during a previous installation) to be ejected out of the jaw follower 408, toward the stein deflector 444. The stem deflector 444 works to deflect the spent stem 600 downward, in a confined area. Subsequently, the power tool and pulling head begin a return stroke, as shown in FIG. 20, whereafter the pulling head 300 comes to a resting position as shown in FIG. 16.

The pulling head 300 described hereinabove provides several advantages, such as but not limited to:

the nosepiece functions to open the jaws a pre-determined distance when the pulling head is not being actuated. As such, a stem can be inserted into the pulling head without causing undue wear on the jaws;

both the nosepiece and the jaw follower tend to center the jaws in the chamber of the carrier. This tends to make the pulling head more reliable and minimizes wear on the jaws, and effectively eliminates the stem slippage problem associated with prior art pulling heads;

because two jaws and a jaw following having two beveled surfaces on its facing surface are provided, only a portion of the back surface of the jaws needs to be angled. As a result, there is no substantial undercut and the jaws can be cast and then used in the pulling head, as opposed to having to be machined to produce a fully angled back surface;

the slots which are provided in the frame of the pulling head are long enough such that the stroke of the pulling head is not effectively limited. As a result, the pulling head can be used in association with a wide range of power tools, each having a different stroke length and/or power rating;

by providing the pulling head along with a set of compatible nosepieces, the appropriate nosepiece can be selected for the job, and the pulling head can be used with a large range of different fasteners.

While embodiments of the present invention are shown and described, it is envisioned that those skilled in the art may devise various modifications of the present invention without departing from the spirit and scope of the disclosure.

What is claimed is:

1. A pulling head system which comprises a pulling head configured for engagement with a pulling tool for pulling a stem, said pulling head comprising a front end having a threaded bore, said system further comprising a plurality of different nosepieces which are configured to threadably engage the threaded bore of the pulling head, wherein each of the nosepieces has a different front surface profile and is configured to be used in connection with a different type of fastener.

2. A pulling head system as recited in claim 1, wherein said pulling head further comprises a frame; a carrier which is disposed inside the frame; a drawbolt adapter which is disposed in the frame and engaged with the carrier, wherein an end of the drawbolt adapter is configured for engagement with the pulling tool; a pair of jaws which are disposed in a chamber in the carrier, said pulling head being configured such that upon said drawbolt adapter being pulled by the pulling tool, said pair of jaws tend to close, said pulling head further comprising a jaw follower which engages an end of the jaws, wherein the jaw follower comprises a front surface which comprises a pair of beveled surfaces, wherein the end of each of the jaws comprises an angled surface which engages a corresponding beveled surface on the jaw follower.

3. A pulling head system as recited in claim 2, wherein each of the jaws of the pulling head comprises a tapered leading edge which is engageable with a corresponding angled end surface of the nosepiece, such that said nosepiece tends to keep the jaws opened and centered about an axis of a bore in the nosepiece.

4. A pulling head system as recited in claim 2, wherein each of the jaws of the pulling head comprises serrations, wherein each of the serrations includes angled end portions, thereby allowing the jaws to grip a range of stems.

5. A pulling head system as recited in claim 2, wherein the jaw follower of the pulling head is spring-biased forward in the chamber of the carrier.

6. A pulling head system as recited in claim 2, said pulling head further comprising a plug member which is engaged with the carrier, and a spring which is disposed between the jaw follower and the plug member.

7. A pulling head system as recited in claim 2, wherein each of the jaws of the pulling head comprises an external surface which provides an angled surface which engages a corresponding angled surface in the chamber of the carrier.

8. A pulling head system as recited in claim 2, wherein the chamber of the carrier of the pulling head does not include an undercut for accommodating the jaws when the jaws open.

9. A pulling head system as recited in claim 2, further comprising a pin which is on the carrier and extends into long slots which are provided in the frame, wherein the pin rides back and forth in the long slots during operation of the pulling head and the long slots are sufficiently long so as to not constrain a stroke of the pulling head.

10. A pulling head configured for engagement with a pulling tool for pulling a stem, said pulling head comprising a frame; a carrier which is disposed inside the frame; a drawbolt adapter which is disposed in the frame and engaged with the carrier, wherein an end of the drawbolt adapter is configured for engagement with the pulling tool; a pair of jaws which are disposed in a chamber in the carrier, said pulling head being configured such that upon said drawbolt adapter being pulled by the pulling tool, said pair of jaws tend to close, wherein each of the jaws comprises serrations, wherein each of the serrations includes angled end portions, thereby allowing the jaws to grip a range of stems.

11. A pulling head as recited in claim 10, further comprising a nosepiece having a threaded portion, wherein said frame comprises a threaded bore configured to receive the threaded portion of the nosepiece, wherein each of the jaws comprises a tapered leading edge which is engageable with a corresponding angled end surface of the nosepiece, such that said nosepiece tends to keep the jaws opened and centered about an axis of a bore in the nosepiece.

12. A pulling head as recited in claim 10, wherein the jaw follower is spring-biased forward in the chamber of the carrier.

13. A pulling head as recited in claim 10, said pulling head further comprising a plug member which is engaged with the carrier, and a spring which is disposed between the jaw follower and the plug member.

14. A pulling head as recited in claim 10, wherein each of the jaws comprises an external surface which provides an angled surface which engages a corresponding angled surface in the chamber of the carrier.

15. A pulling head as recited in claim 10, wherein the chamber of the carrier does not include an undercut for accommodating the jaws when the jaws open.

16. A pulling head as recited in claim 10, wherein the pulling head is part of a pulling head system which comprises a plurality of different nosepieces which are configured to threadably engage a threaded bore of the pulling head, wherein each of the nosepieces is configured to be used in connection with a different fastener or set of fasteners.

17. A pulling head system as recited in claim 10, further comprising a pin which is on the carrier and extends into long slots which are provided in the frame, wherein the pin rides back and forth in the long slots during operation of the pulling head and the long slots are sufficiently long so as to not constrain a stroke of the pulling head.

* * * * *

UNITED STATES PATENT AND TRADEMARK OFFICE

CERTIFICATE OF CORRECTION

PATENT NO. : 7,467,451 B2
APPLICATION NO. : 11/558509
DATED : December 23, 2008
INVENTOR(S) : Cristinel Ovidiu Cobzaru and John Wilker It is certified that error appears in the above-identified patent and that said Letters Patent is hereby corrected as shown below:

Title page, item [30] Related Application (Priority Claim) should read as follows:

-- This application claims the benefit of U.S. Provisional Application Serial No. 60/762,042, filed January 25, 2006, which is hereby incorporated herein by reference in its entirety. --

Column 1, Line 18 "stein of" should be -- stem of --

Column 3, Line 11 "stein to be" should be -- stem to be --

Column 4, Line 5 "steins being" should be -- stems being --

Column 9, Line 19 "steins before" should be -- stems before --

Column 9, Line 30 "stein 384," should be -- stem 384, --

Column 9, Line 37 "stein 384," should be -- stem 384, --

Column 9, line 40 "stein 384," should be -- stem 384, --

Column 9, Line 42 "stein deflector" should be -- stem deflector --

Signed and Sealed this

Nineteenth Day of January, 2010

David J. Kappos

David J. Kappos
*Director of the United States Patent and Trademark Office*